United States Patent [19]

Guim

[11] 4,056,816

[45] Nov. 1, 1977

[54] LIGHT EMITTING DIODE BLOWN CIRCUIT BREAKER INDICATOR

[76] Inventor: Raul Guim, 834 Venetia, Coral Gables, Fla. 33135

[21] Appl. No.: 729,664

[22] Filed: Oct. 5, 1976

[51] Int. Cl.[2] ..... G08B 21/00

[52] U.S. Cl. ..... 340/253 A; 335/17; 337/79; 340/227.1; 340/248 C

[58] Field of Search ..... 340/253 B, 253 A, 248 C, 340/419, 227.1; 335/6, 17; 337/3, 79, 206, 332, 376, 417, 242, 266

[56] References Cited

U.S. PATENT DOCUMENTS

| | | | |
|---|---|---|---|
| 1,649,011 | 11/1927 | Bakken | 335/17 |
| 1,840,114 | 1/1932 | Lazich | 337/3 |
| 2,003,686 | 6/1935 | Giaimo | 335/17 |
| 2,223,530 | 12/1940 | Putman | 340/419 |
| 2,460,759 | 2/1949 | Lawson | 335/17 |
| 2,693,515 | 11/1954 | Hodnette et al. | 340/419 X |
| 2,698,429 | 12/1954 | Treanor | 340/419 |
| 2,704,841 | 3/1955 | Van Ryan | 340/419 X |
| 3,088,009 | 4/1963 | Perez Del Valle | 335/6 |
| 3,562,733 | 2/1971 | Murphy et al. | 340/253 A |
| 3,742,402 | 6/1973 | Nicol et al. | 335/17 X |

*Primary Examiner*—John W. Caldwell, Sr.
*Assistant Examiner*—Daniel Myer
*Attorney, Agent, or Firm*—Gustave Miller

[57] ABSTRACT

This is a blown circuit indicator for a conventional circuit breaker of either bimetallic overload responsive type. It consists of a circuit parallel with the load circuit and which is completed by the overload responsive member when in overload responsive position. This parallel circuit includes a resistor and a light emitting diode positioned remotely from the overload responsive member in a normally visible edge of the casing of the circuit breaker.

6 Claims, 6 Drawing Figures

LIGHT EMITTING DIODE BLOWN CIRCUIT BREAKER INDICATOR

BACKGROUND OF THE INVENTION

Conventional circuit breakers are usually placed in operative position in banks of side by side units, with only the operating handle extending visibly through an edge of the casing of the circuit breaker. This handle has two extreme positions, one when the circuit breaker is in circuit completing position, and the other extreme position in circuit interrupting position. When the load circuit therethrough is overloaded, it "blows," that is, the load circuit is interrupted by a circuit overload responsive element, which simultaneously causes the operating handle to move to an intermediate position. When a number of such circuit breakers are in a group, as they conventionally are, it is difficult to ascertain which circuit breaker has its handle in "blown" position, particularly as most circuit breakers are in cellars or other dark locations, and even when in brightly lit areas, it is difficult to find the particular circuit breaker which has blown, which is very necessary, so that the cause of the overload may be found and corrected before resetting the circuit breaker, the resetting being done by moving the operating handle to the "OFF" position before it can be moved to the "ON" position.

With this invention, a light emitting diode, hereinafter designated as an L.E.D., located in the same casing edge as the handle, lights up and stays lit up so long as the operating handle remains in blown position, thus making it very easy for the blown circuit to be spotted, the cause repaired, and the operating circuit restored.

OBJECTS OF THIS INVENTION

It is an object of this invention to facilitate locating which circuit breaker has blown.

A further object of this invention is to cause a circuit breaker to light up an L.E.D. in the handle edge, so that it visibly indicates which particular circuit breaker has blown.

Yet a further object of this invention is to provide an indicating light on the handle edge of a circuit breaker which lights up and stays lit up when the circuit breaker has blown until the handle has been operated to restore the circuit, presumably after the cause of the overload on the circuit has been corrected.

A still further object of this invention is to provide a parallel circuit through the circuit breaker which is completed by the overload responsive member to light up an L.E.D. in the visible handle edge of the casing of the circuit breaker so that it is readily apparent which circuit breaker has blown.

It is yet a further object of this invention to provide a blown circuit indicator utilizing an L.E.D. located in a readily visible location remote from the location of the overload responsivle component so that any heat, if caused by the overload responsive component, will be too far from the L.E.D. to cause damage thereto.

A further object is to provide a visible light indication to any conventional circuit breaker to show that the circuit breaker has blown, typical circuit breakers being shown in U.S. Pat. Nos. 2,618,716; 2,663,773; 2,781,433; 2,924,683; 2,989,604; 3,636,482; 3,930,211.

BRIEF DESCRIPTION OF THE DRAWINGS

With the above and other related objects in view, this invention consists in the details of construction and combination of parts as will be more fully understood from the following description, when read in conjunction with the accompanying drawings, in which.

DETAILED DESCRIPTION OF THE INVENTION

Figure 1:
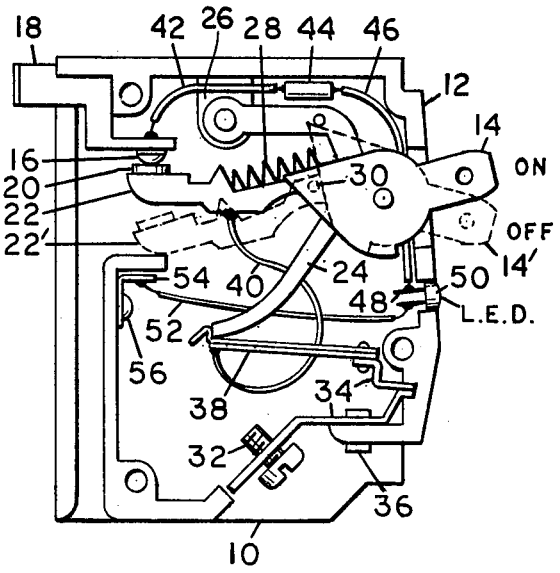
FIG. 1 is an elevation view of the conventional bimetallic circuit breaker to which the parallel L.E.D. operating circuit of this invention has been added, the mechanism being shown in dotted position when in "OFF" position, the face or cover of the casing being omitted.

There is shown at 10 the housing or case of suitable insulating material and in which the cover or face is omitted from the illustration to enable the interior parts to be illustrated. The case and cover are typically of molded insulating plastic. The various elements of the circuit breaker mechanism, this invention, and the handle edge 12 through which the handle 14 extends, are mounted within the case 10 and held in place by a conventional cover (not shown). The handle 14 is shown in load circuit "ON" position 14. In dotted outline, the handle is shown in "OFF" position 14' and at 14-B.P., the handle is shown in circuit breaker blown position.

A fixed contact 16 is mounted on a line terminal clip 18 which is designated to engage a line bus when the circuit breaker is inserted into a distribution panel, often in a dark or not readily lighted location. A movable contact 20 is mounted on a contact carrier 22.

Figure 2:
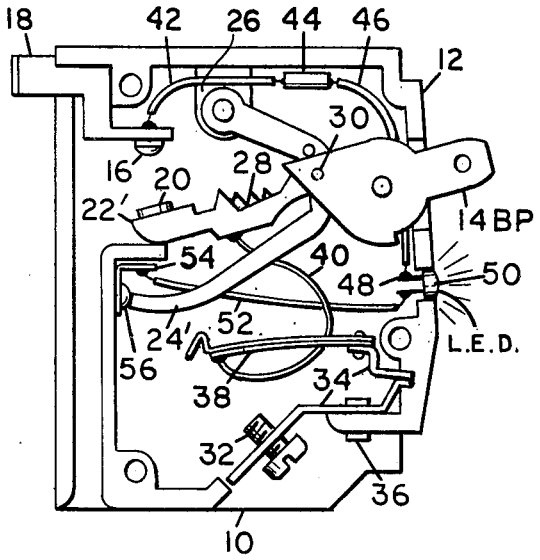
FIG. 2 is a similar view after an overload has caused the circuit breaker to blow.
Figure 3:
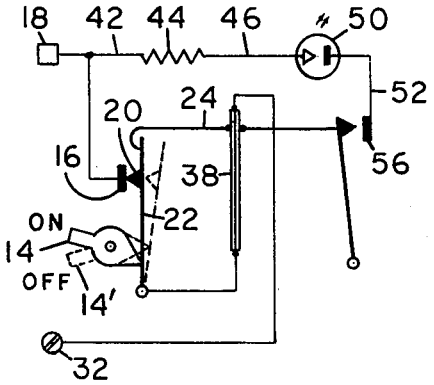
FIG. 3 is a diagram of the circuit in FIG. 1 in "ON" and "OFF" positions.
Figure 4:
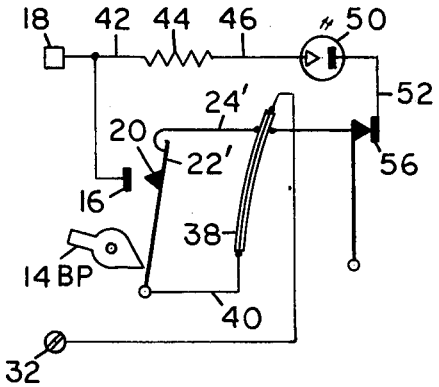
FIG. 4 is a diagram of the blown load circuit and the L.E.D. operating circuit.

A trip arm 24 is pivoted on a boss 26 in the case 10 for pivoting between the set position shown in FIG. 1 and the tripped position shown in FIG. 2. An overcenter tension spring 28 has one and connected to the contact carrier 22 and the other end connected to the trip arm 24. The handle 14, contact carrier 22 and spring 28 form an overcenter arrangement, or toggle, which serves as an operating mechanism and urges the movable contact 20 towards the fixed contact 16 when the spring 28 is on one side of the pivot point 30 shown in FIG. 1 and urges the movable contact 20 to the open position when the spring 26 is on the other side at the pivot point 30, as shown in FIG. 2. A load terminal connecting screw 32 for connecting the circuit breaker to a load circuit is also positioned in the molded case 10.

The load terminal connecting screw 32 is threaded through a bus bar 34 riveted or screwed in the case 10 at 36. The current responsive member of the overload tripping mechanism is a thermally responsive or bimetallic latching member 38 which is electrically connected to the movable contact 22 by a flexible conductor 40 of stranded wire, typically copper wire.

The thermally responsive latching member 38 is a generally hook-shaped thermostat element of at least two layers of metal having different coefficients of thermal expansion so that the element bends as its temperature increases. One end of the flexible conductor 40 is attached directly to the bimetallic member 38 at one end and its other end is connected to contact carrier 22, the other end of the bimetallic member 38 being connected through bus bar 34 to the terminal load screw 32.

The circuit breaker operates in the customary manner for opening and closing the contacts, and also for tripping under the action of an overload. As thus far described, this circuit breaker is conventional and operates in the customary manner. This conventional construction is the same as disclosed in U.S. Pat. No. 3,930,211 and also in many other prior patents in this art.

This invention consists in providing a light emitting diode in a parallel circuit between the line terminal clip 18 and the load terminal screw 32. An insulated conductor 42 is connected at one end to the back of the line terminal clip 18 and at its other end is connected to a resistor 44. The resistor 44 in turn is connected through a second conductor 46 to one side 48 of a light emitting diode 50 which extends through and is countersunk in the case edge 12 and thus is prominently visible. The other side of the L.E.D. 50 is connected by a conductor 52 to an arm 54 having a contact 56. The contact 56 provides an electric connection to the trip arm 24 when the arm has been tripped to the position 24', shown in FIG. 2. The current then passes through the trip arm 24' to the contact carrier 22, now in position 22'. Then, from moved contact arm 22', the current travels through the conductor 40 to the bimetallic member 38 and thus through bus bar 34 to the load terminal screw 32 to which the load is normally connected.

Figure 5:
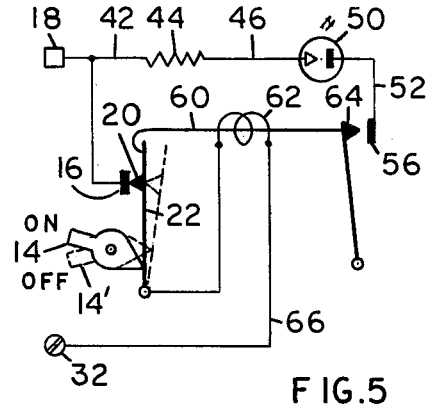
FIG. 5 is a diagram of a magnetic circuit breaker, in "ON" and "OFF" positions.
Figure 6:
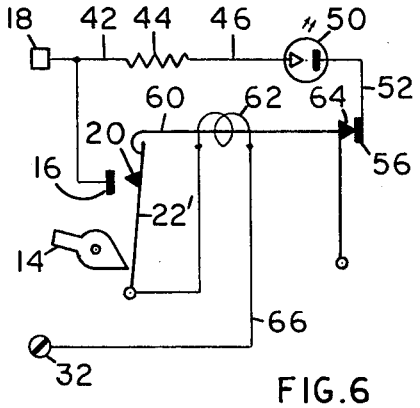
FIG. 6 is a diagram of FIG. 5 after it has blown and completed the parallel circuit to the L.E.D.

In the magnetic circuit breaker, shown diagramatically in FIGS. 5 and 6, the same reference numbers are used where they apply to the same elements. In this case, there is an armature 60 extending through the magnetic coil 62. It also electrically connects the contact carrier 22 to contact 64 after the load circuit is blown. The armature 60 then completes the circuit through contact 56 to connector 52 and diode 50. When there is an overload, the armature 60 pulls the contact carrier 22 to move its contact 20 away from terminal contact 16 and moves contact 64 into circuit completing position with contact 56. This causes the circuit from the line bus 18 to pass through connector 42 to resistor 44 to conductor 46 and the L.E.D. 50 to light up and remain lit, and the circuit path then continues through armature 60 through contact carrier 22 and through the magnetic coil 62 and connector 66, to the load terminal screw 32.

OPERATION OF THE INVENTION

In operation, the manual handle 14 operates contact carrier 22 to make or break the circuit through contact 16 and bus bar terminal 18 in the normal manner in either form. When there is an overload in the circuit, in FIGS. 1 through 4, the circuit from the contact 16 to the contact carrier's contact 20 is broken by the bimetallic member 36 and the tripper arm 24 is moved to position 24', completing a circuit from 52 through 56 and tripper arm now in position 24' through the diode 50, lighting it up to remain lit until the handle 14 is operated, after the cause of the overload has been repaired, to restore normal service. The same is true in the magnetic circuit breaker of FIGS. 5 and 6. The overload interrupts the load circuit by the coil 62 moving the core 60 to interrupt the load circuit between contact 16 and carrier contact 20, and completes the circuit between armature contact 64 and diode contact 56 to light up the diode and keep it lit until serviced.

ABSTRACT OF THE DRAWING

In the drawing, like numbers refer to like parts, and for the purposes of explication, set forth below are the numbered parts of this improved LIGHT EMITTING DIODE BLOWN CIRCUIT BREAKER INDICATOR:

10 case of circuit breaker
12 handle edge of 10
14 manually operating handle in "ON" position
14' handle 14 in "OFF" position
14-B.P. handle 14 in blown position
16 fixed contact on 18
18 line terminal clip
20 movable contact on 22
22 contact carrier, in circuit completing position
24 trip arm
24' trip arm in contact position with 56 (FIGS. 3 and 4)
26 pivot for 24
28 overcenter tension spring
30 pivot point
32 load terminal connecting screw in 34
34 bus bar
36 fastening for 34 in case 10
38 thermal responsive bimetallic latching member
40 flexible conductor from 38 to 22
42 insulated conductor from 16 to 44
44 resistor
46 conductor from 44 to L.E.D. connector 48
48 L.E.D. connector
50 L.E.D.
52 conductor from 50 to a contact carrying arm 54
54 contact carrying arm
56 contact on 54
60 armature
62 magnetic coil
64 contact at end of 60

Although this invention has been described in considerable detail, such description is intended as being illustrative rather than limiting, since the invention may be variously embodied within the scope of what is claimed.

Having thus set forth the nature of this invention, what is claimed is:

1. In a conventional circuit breaker (10) having a stationary contact (16) on a line terminal clip (18), a movable contact (20), a contact carrier (22) having the movable contact (20) mounted thereon, an operating mechanism including a handle (14) for manually moving the movable contact carrier (22) to selectively open and close the line circuit contact (16 and 20), a load terminal (32) from which the load circuit extends through the line contacts (16 and 20), a tripping mechanism including an overload circuit responsive member (38) in the load circuit between the movable contact (20) and the load terminal contact (32) for moving the contact carrier (22) to open the contacts and interrupt the load circuit in response to an overload condition through the overload responsive member (38); the improvement comprising a blown circuit indicator circuit (42–56 and 24', 22, 40) in parallel with the load circuit, said blown load circuit indicator parallel circuit being connected to the line circuit and load circuit terminals (18 and 32) and through and including a resistor (44) in series with a light emitting diode (50), a fixed contact (56), and a movable parallel circuit contact (24') held in parallel circuit interrupting position by said overload responsive member (38) until said overload responsive member is actuated to load circuit interrupting position to thus actuate said parallel circuit contact (24') to parallel circuit completing position (24') to light up said light emitting diode (50) to remain lit up to indicate that the load circuit breaker has blown.

2. The blown circuit indicator of claim 1, said light emitting diode (50) being located physically remote from the overload circuit responsive member (38).

3. The circuit breaker of claim 2, and thus protected from the heat of the blowing overload circuit responsive member (38).

4. The circuit breaker of claim 1, the circuit breaker including a heat responsive element (38) to break the circuit when there is an overload present; the improvement including the light emitting diode (50) being physically remote from the heat responsive element (38) to protect the light emitting diode (50) from the heat of the heat responsive element (38).

5. The circuit breaker of claim 1, the circuit breaker including a magnetic overload circuit interrupter (60, 62).

6. The circuit breaker of claim 1, said light emitting diode (50) being located in and visible through the edge of the case (10) of the circuit breaker through which the operating handle (14) extends.

* * * * *